United States Patent [19]

Gerlach

[11] 3,944,634

[45] Mar. 16, 1976

[54] CARBURETOR IDLING SYSTEM

[75] Inventor: Charles R. Gerlach, San Antonio, Tex.

[73] Assignee: John M. Anderson, Corpus Christi, Tex.

[22] Filed: May 29, 1973

[21] Appl. No.: 364,491

[52] U.S. Cl...... 261/41 D; 123/119 A; 123/122 AA; 261/64 R; 261/78 R; 261/79 R; 261/121 B

[51] Int. Cl.[2] ..... F02M 11/00

[58] Field of Search.. 261/41 D, 78 R, 79 R, 121 B, 261/64 R; 123/5 LM, 119 A, 122 A, 122 AA

[56] References Cited

UNITED STATES PATENTS

| | | | |
|---|---|---|---|
| 3,408,054 | 10/1968 | Walker | 261/41 D X |
| 3,544,083 | 12/1970 | Currie | 261/41 |
| 3,667,221 | 6/1972 | Taylor | 261/79 R X |
| 3,690,305 | 9/1972 | Shimada et al. | 261/41 D X |

FOREIGN PATENTS OR APPLICATIONS

| | | | |
|---|---|---|---|
| 1,214,071 | 12/1970 | United Kingdom | 261/41 D |

*Primary Examiner*—Tim R. Miles
*Assistant Examiner*—William Cuchlinski, Jr.
*Attorney, Agent, or Firm*—Fulbright & Jaworski

[57] ABSTRACT

An improved idling system for a carburetor in which the idling fuel is directed into the carburetor or manifold at a point spaced downstream from the throttle valve, and an air bleed modulation passageway for conducting air to a position adjacent the outlet of the idling fuel for controlling the air pressure at the idling fuel outlet for controlling the idle fuel flow rate. The air modulation passageway varying the idle fuel delivery as a function of throttle position and manifold pressure. A vortex chamber having a tangential air inlet for receiving and atomizing the idle fuel and air. Various tail pipe modifications may be connected to the outlet of the vortex for varying the fuel delivery characteristics. A convergent-divergent passageway may be provided between the idle fuel-air mixture prior tc its injection into the intake manifold. Hot exhaust gases may be injected into the idle fuel-air mixture for better atomization, and exhaust gas may be used to externally heat the air-gas mixture. The idling fuel-air mixture may be conducted to each of the intake valves on each cylinder for correctly controlling the fuel-air ratio in each cylinder for reducing vehicle emissions.

7 Claims, 8 Drawing Figures

CARBURETOR IDLING SYSTEM

BACKGROUND OF THE INVENTION

Vehicle emission standards set and proposed by the United States government are verified by test conditions which generally are biased toward low speed operation and stop-and-go situations. With these conditions, the engine is operating almost entirely from the idle fuel delivery system of the carburetor. Typical idle systems provide poor atomization of the fuel and consequently cause imbalanced fuel-air mixtures to the various cylinders of the engine. For minimum hydrocarbon and carbon monoxide emissions, the fuel-air ratio of each cylinder must be precisely the same, and this has only been approximately achieved to date by expensive fuel injection systems. Any improvements which can be made to conventional carburetor idle circuits which better atomize the fuel and more precisely control the fuel-air ratio will permit achievement of attractive reductions of vehicle emissions. The conventional idle systems have two major drawbacks relative to metering for achieving reduced engine emissions; first, the fuel-air delivery results in inadequate fuel vaporization prior to introduction into the intake manifold and, second, the conventional system characteristically meters relatively richer as the intake manifold vacuum increases.

The present invention is directed to various improvements of the idling system of a carburetor for overcoming the disadvantages of the existing systems.

SUMMARY

The present invention is directed to various improvements of the carburetor idling system of an engine. One feature of the present invention is the positioning of the idle fuel supply outlet or outlets to the carburetor downstream and spaced from the throttle valve for increasing better balanced fuel-air mixtures to the various cylinders of the engine and decreasing hydrocarbon and carbon monoxide emissions.

Yet a still further object of the present invention is the provision of a vortex chamber for atomization of the fuel and air mixture of the carburetor idling system.

Still a further object of the present invention is the provision of various tail pipe modifications which are utilized with the vortex chamber for varying the fuel delivery characteristics as desired.

Yet a further object of the present invention is the provision of a convergent-divergent nozzle between the outlet of the idle fuel supply and the intake manifold.

Yet a still further object of the present invention is the provision of an air bleed modulation of the idling fuel for controlling the air pressure at the idling fuel outlet thereby controlling the idling fuel flow rate. The modulation passageway may be made variable to vary the idle fuel delivery properly as a function of throttle position and manifold pressure. One modulation system utilizes a variable opening such as a contoured pintle or needle which moves in a fixed orifice as a function of throttle setting and thereby varies the effective air bleed orifice size. Another embodiment of the air modulation system utilizes the throttle valve to vary the relative upstream and downstream areas on a modulation or transfer slot opening to the modulation passageway.

Yet still a further object is the provision of utilizing hot exhaust gases in the idling system of the carburetor to heat the idle fuel-air mixture for better atomization by injecting the hot exhaust gases into the idle air-fuel mixture and/or utilize the exhaust gases from the engine to externally heat the idle air-fuel mixture where exhaust gas injection into the air-fuel mixture is not required for supressing the rate of combustion which reduces the level of nitrous oxides present in the exhaust.

Yet a further object is the provision of a passageway leading from the idling air-fuel mixture to each of the intake valves of each cylinder of the engine for insuring that the fuel-air ratio of each cylinder is generally the same for reducing emissions from the engine.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

Figure 1:
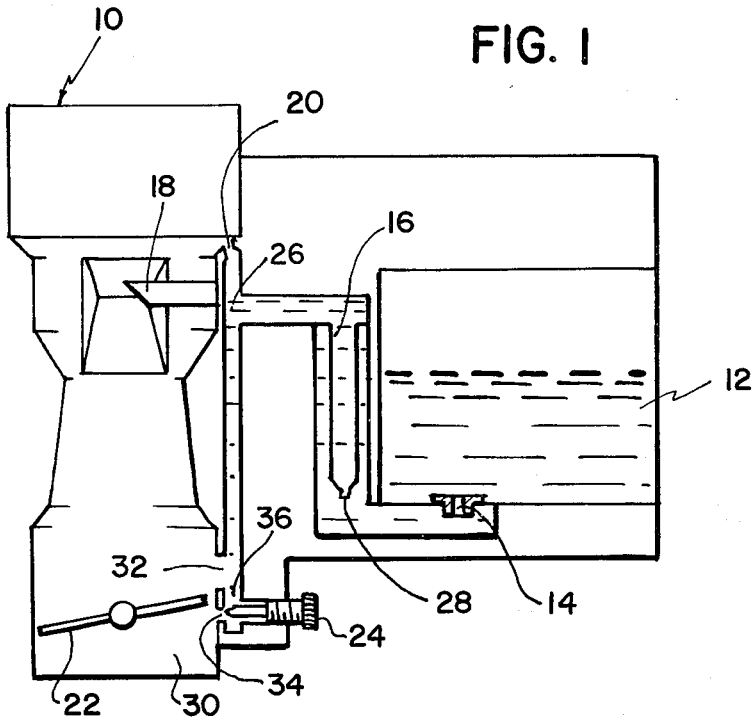
FIG. 1 is a schematic elevational view showing the idling system of a conventional carburetor.

Referring now to FIG. 1, a typical and conventional carburetor generally indicated by the reference numeral 10 is shown having a fuel supply 12, a main orifice jet 14, an idle fuel tube 16, a main fuel outlet 18, an idle air bleed 20, a throttle valve 22, and an idle mixture adjusting screw 24. The idle fuel motion results because the pressure at location 26 is lower than the pressure at location 28 and the differential pressure between the points 26 and 28 represents the driving force for the idle fuel flow.

The magnitude of the pressure differential from point 28 to point 26 is controlled by the intake manifold absolute pressure at location 30, the position of the throttle valve 22 relative to the transfer passage 32, and the position of an adjusting screw 24 controlling the idle port 34. For a given manifold absolute pressure value, the absolute pressure at point 36 is progressively reduced as the throttle valve 22 is opened since the transfer passage 32 is being progressively exposed to the influence of the manifold pressure at location 30. It is to be noted that the term "idle system" used in this specification refers to the idle system using only idle port 34 and the off-idle or transition function of the carburetor as the throttle valve 22 is partially opened discharges fuel both through port 34 and passage 32.

As the absolute pressure at point 36 is reduced, the absolute pressure at point 26 is also reduced, but to a lesser extent because of the air introduced at the idle bleed 20. The size of the idle blee 20 and the fixed idle port 34 and transfer passageway 32 represent variables used to vary the calibration of the conventional idle system to suit the requirements of a given engine.

The fuel-air mixture at point 36 is subsequently dumped into the intake manifold through the idle discharge port 34 when the throttle valve 22 is closed (engine idle) or partially through the transfer passage 32 for the off-idle or partial opening of the throttle valve 22. In the conventional carburetor, the fuel discharge at the idle port 34 gives poor mixing and inadequate atomization. The net result is improper air-fuel distribution from cylinder to cylinder of the engine. Some cylinders consequently run richer or leaner than the average air-fuel ratio calculated for the engine based on total air flow and total fuel flow. One of the problems to which the present invention is directed is that of providing a more thorough atomization of the idle and off-idle fuel-air mixture prior to introduction into the intake manifold.

It should also be noted that the calibration obtainable with the conventional idling system illustrated in FIG. 1 is always inferior to the desired calibration in that the mixture produced is relatively lean for low manifold vacuums (high load) and relatively rich for high manifold vacuum values. In fact, it would be most desirable to achieve the reverse situation with a progressive, enrichening as the manifold vacuum is decreased. The reason for this undesirable enrichening at high engine vacuums with a conventional idle system is that, when the air flow past the throttle valve sonically chokes for manifold pressures roughly one-half or less than the surrounding absolute pressures, limiting the maximum air flow, the idle pressure at point 36 continues to depress as the manifold pressure is depressed causing delivery of more and more fuel. In summary, the conventional idling system of the proper carburetor 10, shown in FIG. 1, has two major drawbacks relative to metering fuel for achieving reduced engine emissions; first, the fuel-air delivery results in inadequate fuel vaporization prior to introduction into the intake manifold and, second, the conventional idling system characteristically meters relatively richer as the manifold vacuum increases.

While a considerable amount of attention has been directed recently at improvements in the main metering function of a carburetor, little attention has been given to improvement of the idling system and the present invention is directed to various improvements in the idling system for providing better atomization of the fuel, better balance between the fuel-air mixtures to the various cylinders of the engine and to more precisely control the fuel-air ratio, all of which will permit reductions of vehicle emissions.

Figure 2:
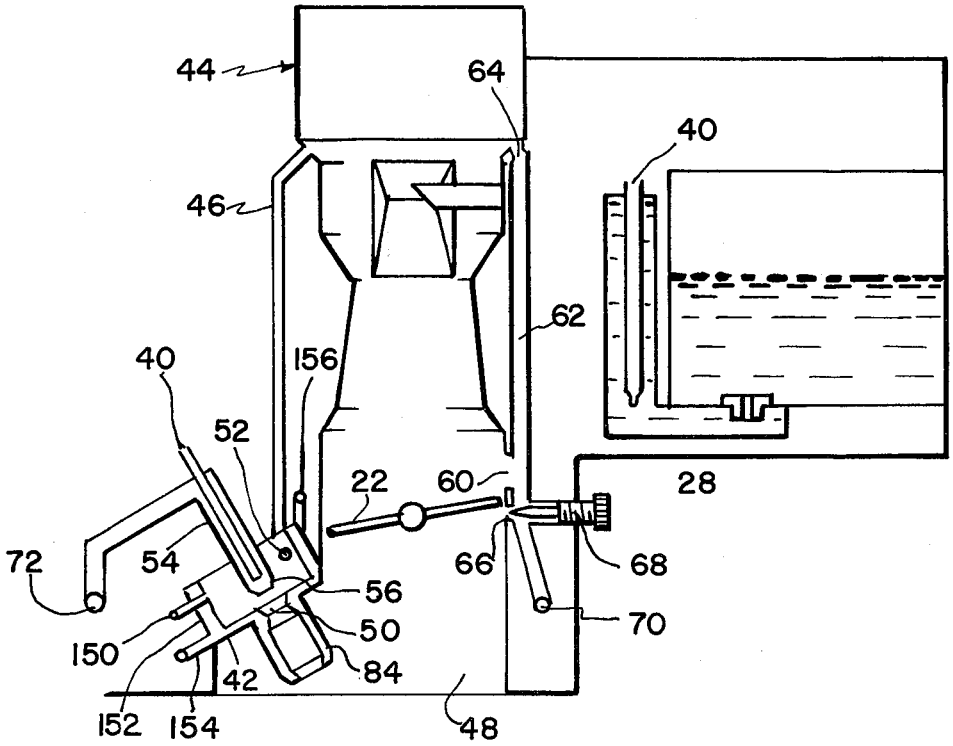
FIG. 2 is a schematic elevational view of one embodiment of an improved idling system of a carburetor.

Referring now to FIG. 2, one embodiment of an improved carburetor idling system is disclosed. The idle fuel is drawn through an idle fuel tube 40 from the usual carburetor fuel supply by the depressed pressure generated within a vortex chamber 42, which may be mounted within or without the body of a conventional carburetor 44 as desired. The vortex chamber 42 functions to create an atomization of the fuel with air to create a fuel-air mixture vortex action caused by a tangential inlet of ambient air through an air inlet 46 which is in communication with ambient air. The vortex is created when the depressed pressure in the intake manifold 48, which communicates with the vortex chamber 42 through a discharge orifice 50, creates a suction of air through the air inlet 46 tangentially entering the vortex chamber through vortex inlet 52. The size of the inlet 52 governs the quantity of air entering and this quantity is always chosen to be somewhat less than the total quantity of air required by the engine. Near the central discharge orifice 50 from the chamber 42, an air-fuel mixture is drawn from an emulsion tube 54 and then introduced into the high velocity breakup zone within the vortex chamber 42. The majority of the atomization occurs at this point as the fuel drops are aceelerated by the high velocity air within the vortex.

The quantity of fuel drawn into the emulsion tube 54 from the fuel tube 40, for a given pressure differential from ambient to the manifold pressure, is determined or modulated by an amount of bleed or modulated air introduced into the emulsion tube 54, creating a differential pressure across the outlet of the emulsion tube. The greater the quantity of modulated air, the higher the absolute pressure at location 56 and the smaller the idle fuel flow rate into the emulsion tube 54.

Air bleed modulation of the improved idling system of the present invention can be achieved in one of several ways. The purpose of air bleed modulation is to vary the idle fuel delivery properly as a function of throttle position and manifold pressure. For each throttle setting, a certain fuel flow versus manifold pressure characteristic is required to achieve a proper overall air-fuel ratio. One type of air bleed modulation system is shown in FIG. 2 in which the throttle valve 22 varies the relative upstream and downstream areas on a modulation or transfer slot 60 which is connected to an air modulation passageway 62. One end 64 of the passageway 62 is connected to ambient air and includes a variable idle air bleed 66 in communication with the intake manifold vacuum 48 and controlled by screw 68. The resultant modulation system is connected through the end 70 of the passageway 62 to the emulsion tube 54 by connection to tube 72. While the modulation air bleed system shown in FIG. 2 is somewhat similar to the suction signal generated in the idle system of the conventional carburetor of FIG. 1, the resultant air modulation in FIG. 2 is used to modulate the fuel delivery vortex chamber 42 instead of simply drawing idle fuel through the fuel tube 40, which receives fuel from the location 28 shown in FIG. 1.

In order to provide a proper fuel-air ratio to the engine, the idle system must deliver fuel as a function of both engine vacuum and throttle position. Thus, the fuel modification must be accomplished properly as a function of these two variables.

Figure 5:
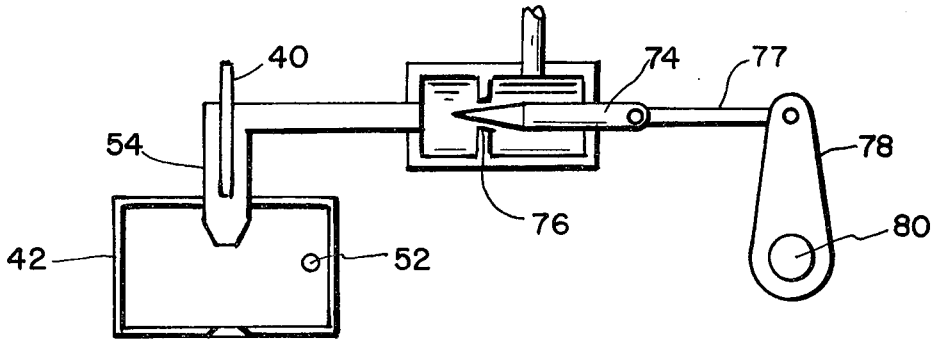
FIG. 5 is a schematic view of another embodiment of an air modulation system for the idling system of a carburetor.

One attractive feature of the new idle system concept shown herein is that there are a number of design parameters which can be adjusted to give the correct fuel delivery as a function of manifold absolute pressure and throttle position. Referring now to FIG. 5, another modulation system which can be used to supply modulated bleed air to the emulsion tube 54 is shown. The modulation system utilizes a variable opening in the air modulation passageway such as providing a contoured or tapered pintle or needle 74 which moves in an orifice 76 to vary the effective area of the orifice. The needle 74 is connected by a link 77 to a lever arm 78 on the carburetor shaft 80. Thus, the needle 74 moves in the orifice 76 as a function of throttle setting and thereby varies the effective air bleed size of the orifice 76 controlling the amount of modulated air flowing from an ambient air inlet passageway 82 to the emulsion tube 54. The variable orifice 76 functions to reduce air bleed progressively as the throttle is opened thereby providing an increase in idle fuel delivery for an increased air flow to the engine.

Figure 6:
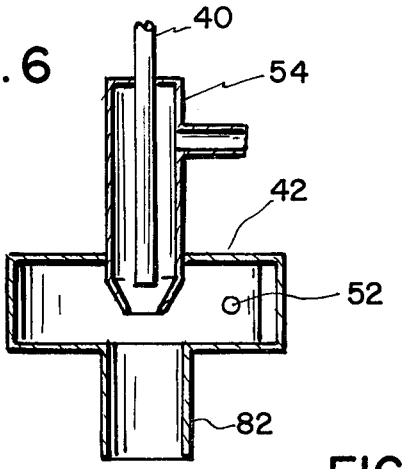
FIG. 6 is an enlarged elevational view showing another type of tail pipe connected to the outlet of the vortex chamber of the idling system of FIG. 2.
Figure 7:
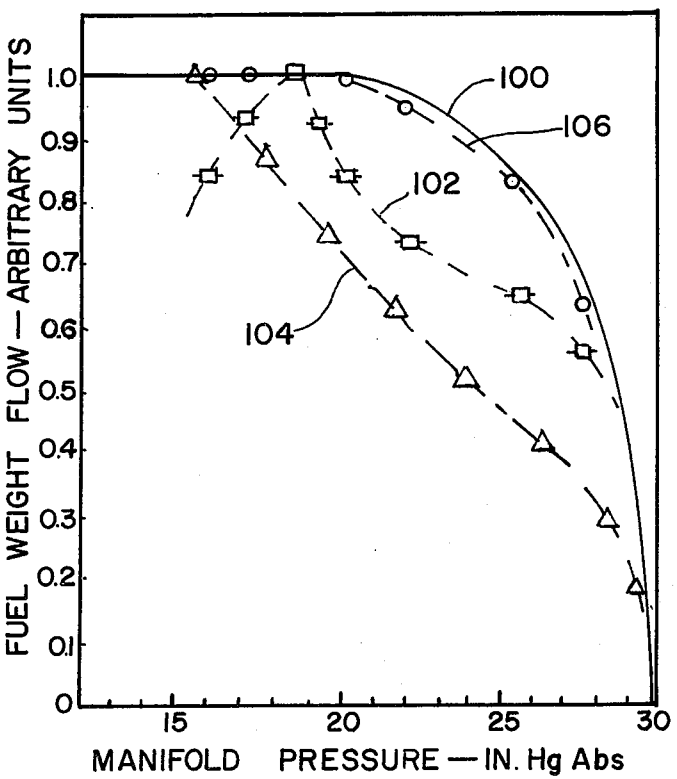
FIG. 7 is a graph showing the fuel delivery characteristics of various types of vortex outlets.

While the discharge from the vortex chamber 42 may merely include the orifice discharge 50 in FIG. 2, other modified discharge configurations may be used to vary the fuel delivery characteristics. FIG. 6 illustrates a tubular tail pipe 82 connected to the outlet of the vortex chamber 42, and FIG. 2 may include a tail pipe for connection to the discharge of the vortex chamber 42 which includes a divergent-convergent tail pipe 84. Referring to the graph in FIG. 7, the effect of various discharge configurations on the fuel delivery for a fixed air bleed (representing a fixed throttle position) is shown as compared with an ideal idle fuel delivery curve. The ideal idle fuel delivery curve 100 shows the fluid weight flow versus the manifold pressure for an ideal fuel flow which is not achieved with a conventional or present design carburetor. Using only the orifice discharge 50 shown in FIG. 2 gives a graph 102 showing that it gives a fuel delivery which is too lean at intermediate and low manifold pressures. The tail pipe configuration 82 in FIG. 6 provides a graph 104 which gives a fuel delivery which is too lean except for very low manifold pressure values. However, the divergent-convergent tail pipe 84 of FIG. 2 gives a fuel delivery graph 106 very close to the ideal required curve 100, and which is much improved over the idle delivery of a present design carburetor.

Figure 8:
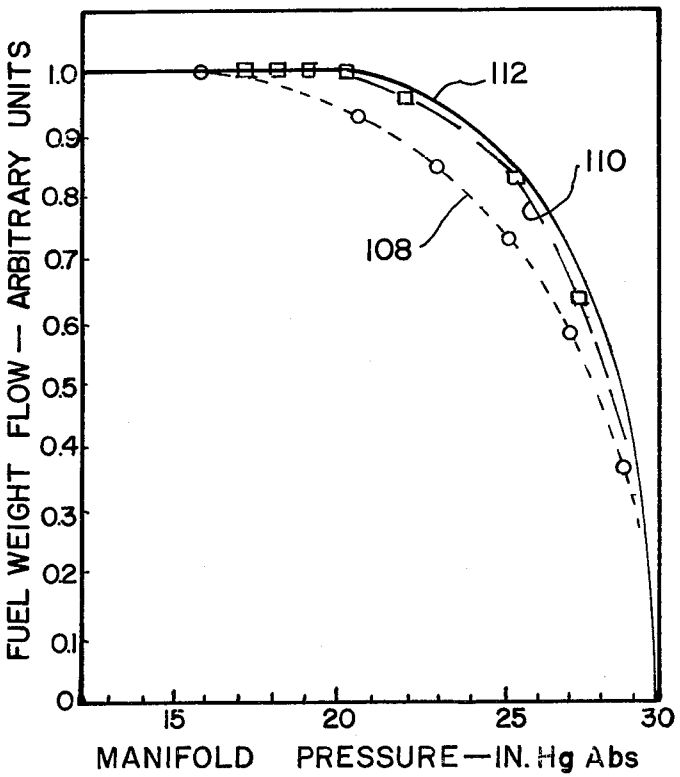
FIG. 8 shows a comparison of the delivery characteristics of a conventional idle circuit with that of the divergent-convergent tail pipe configuration shown in FIG. 2.

Referring now to the graph in FIG. 8, a comparison is shown of the idle delivery characteristic of a conventional idle system such as shown in FIG. 1, with the improved idling system shown in FIG. 2 utilizing the divergent-convergent tail pipe 84. The conventional system, as shown in graph 108, notes that the conventional system now used on vehicles results in a lean condition for intermediate manifold pressures which is largely responsible for the off-idle stumble or hesitation present in new cars with carburetors set for "best emission" qualities. The conventional idle system does not permit the freedom of fuel delivery tailoring possible as with the system of FIG. 2. The apparatus of FIG. 2 utilizing the tail pipe configuration 84 provides a graph 110 which is very close to the ideal fuel flow required in graph 112 with a fixed throttle angle. Therefore, the convergent-divergent tail pipe 84 of FIG. 2 permits a more accurate fuel-air ratio metering along with improved atomization.

The idling system shown in FIG. 2 utilizes a vortex chamber to draw the idle fuel from the conventional carburetor fuel well, atomize the idle fuel and discharge it in a proper manner into the intake manifold. Another embodiment for accomplishing the same results utilizes a convergent-divergent nozzle passageway instead of the vortex chamber of FIG. 2. The embodiment shown in FIG. 3 includes a nozzle or passageway 120 of a fixed geometrical configuration which is positioned between the outlet of the idle fuel tube 122 and the intake manifold 124. The passageway 120 is opened at end 126 to the atmosphere into the manifold 124. The size of the nozzle 120 is chosen so that the air flow under a closed throttle idle condition is somewhat less than the total engine requirement for this same condition. The fuel-air mixture discharged at the manifold end of the passageway 120 is fuel rich, but upon mixing with air passed through the throttle valve 128 attains a correct overall mixture strength. The area ratio of the duct cross section 130 to the nozzle minimum area 132 is a primary parameter in adjusting the fuel delivery characteristic. The idle fuel is drawn through the idle fuel tube 122 from the normal idle orifice location 28 and then into the convergent section 134 where it mixed with the idle bypass air and then passes through the divergent section 136. Modulation of the suction or low pressure signal through the emulsion tube 138 is provided by the use of a suitable air modulation passageway such as that shown in FIG. 5 or by the air modulation system generally referred to in FIG. 3 as number 140 which is similar to the air bleed modulation system shown in FIG. 2. Delivery of the fuel from the tube 122 and the modulated bleed air is from the emulsion tube 138 and into the convergent portion 134 of the passageway 120.

Figure 3:
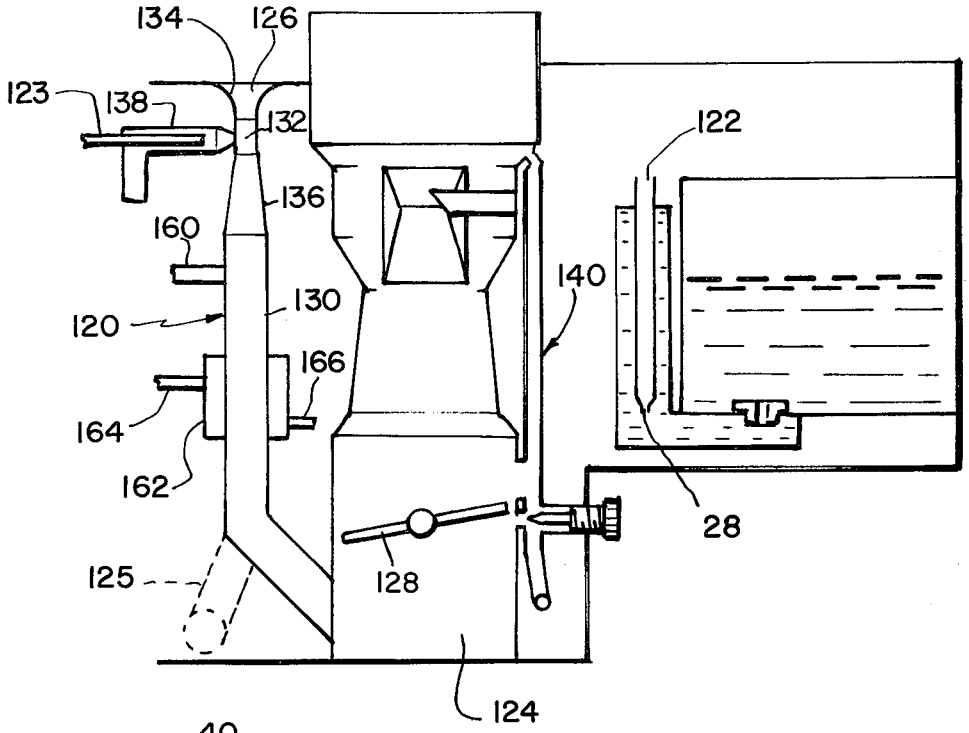
FIG. 3 is a schematic elevational view of another embodiment of an improved idling system of a carburetor.

In addition, additional features may be provided to either of the carburetor idling systems of FIG. 2 or FIG. 3 to provide additional advantages. First, it has been found that a quantity of hot exhaust gas can be beneficially injected into the idle fuel-air mixture for even better atomization, and in the case of the vortex chamber of FIG. 2 to enhance the vortex motion. The injection of some exhaust gas into the engine is also known to have a suppression effect on the rate of combustion which reduces the level of nitrous oxides present in the exhaust. Exhaust gas can also be used to externally heat the idle air-fuel mixture with, or without using exhaust gas injection into the mixture, for greater efficiency. With a conventional carburetor it is not practical to preheat the idle mixture from within the carburetor with exhaust gases since this would overheat the entire carburetor assembly. In the embodiments of FIGS. 2 and 3, the idle fuel delivery system is removed from the main fuel supply, and the idle delivery may be remotely located and spaced downstream from valve 22 and thermally isolated to accommodate the use of exhaust injection and/or external exhaust heating without disturbing the parent carburetor, and to improve the distribution of idle air-fuel mixture.

Referring now to FIG. 2, hot exhaust gas may be transmitted from the exhaust manifold of the engine through a line 150 to the interior of the vortex chamber 42 to enhance the vortex motion and to heat the fuel-air mixture for better atomization and reducing the level of nitrous oxides in the engine. In addition, a heat exchanger 152 may be provided surrounding the exterior of the vortex chamber 52 having an inlet line 154 from the exhaust manifold and an outlet line 156 for externally heating the vortex chamber 42 for greater efficiency.

The embodiment of FIG. 3 may also utilize exhaust gas injection and/or external heating of the fuel-air mixture. Referring now to FIG. 3, a line 160 may be provided from the exhaust manifold of the engine leading into the passageway 120 for supplying exhaust gas into the engine for the reasons previously given. In addition, the heat exchange jacket 162 may be provided around the passageway 120 having an inlet line 164 leading from the exhaust gas manifold and an outlet line 166 so as to place the fuel-air mixture passing through the passageway 120 in a heat exchange relationship with the exhaust gas.

Figure 4:
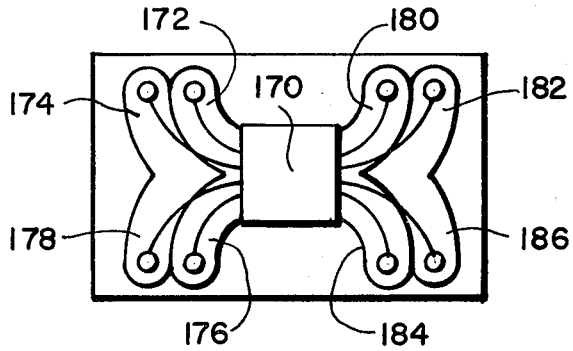
FIG. 4 is an elevational view showing the discharge of the idling fuel-air mixtures from a parent carburetor to the intake valves of each cylinder of an eight cylinder engine.

As previously mentioned, it is desirable that the fuel-air ratio of each cylinder be precisely the same. To improve the balance of the fuel-air mixture to each of the cylinders, the embodiments of either FIG. 2 or 3 may include passageways conducting the fuel-air mixture in equal streams to a position adjacent the intake ports of each cylinder. Referring now to FIG. 4, a parent carburetor 170 may be provided having a plurality of cylinders which in the case of the embodiment of FIG. 2 includes a plurality of fuel injection tubes 40 and vortex chambers 42 equal to the number of cylinders, and in the case of the embodiment of FIG. 3, includes a plurality of convergent-divergent passageways 120. In the case of an eight cylinder engine, passageways 172, 174, 176, 178, 180, 182, 184 and 186 lead from the exhaust of each of the air fuel discharge outlets to a position above the intake port of each cylinder for proper proportioning of the idling fuel-air mixture to the engine. With delivery to each intake port, fine tuning of the mixture strength to each cylinder is provided, cancelling out small variations in the mixture ratio between the individual cylinders which are attributable to the manifold configuration, and which occurs despite good atomization prior to the idle fuel and bleed air mixture. With the individual intake port delivery system of FIG. 4, it is also possible through proper location and orientation of the delivery tubes immediately above each intake valve to achieve some degree of charge stratification within each cylinder which provides a beneficial effect with regard to engine exhaust emissions.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In a carburetor for mixing air from an air intake and fuel from a fuel supply and having a throttle valve for an engine having an intake manifold and exhaust manifold, the improvement in an idling system comprising, an idle fuel and off idle fuel delivery tube in communication with the fuel supply and leading into the carburetor downstream and spaced from and independently of the throttle valve, an air modulation passageway one end of which is in communication with air and the second end of which is positioned adjacent the outlet of the idle fuel tube for controlling the air pressure at the fuel tube outlet for controlling the idle fuel flow rate, said modulation passageway includes a variable opening, and the modulation passageway includes a modulation slot opening into the passageway and positioned adjacent and coacts with the throttle valve.

2. In a carburetor for mixing air from an air intake and fuel from a fuel supply and having a throttle valve for an engine having an intake manifold and exhaust manifold, the improvement in an idling system comprising, an idle fuel and off idle fuel delivery tube in communication with the fuel supply and leading into the carburetor downstream and spaced from and independently of the throttle valve, an air modulation passageway one end of which is in communication with air and the second end of which is positioned adjacent the outlet of the idle fuel tube for controlling the air pressure at the fuel tube outlet for controlling the idle fuel flow rate, a vortex chamber having an air inlet and positioned at the outlet of the idle fuel tube for atomizing the fuel and air and including an orifice at the chamber outlet, a tail pipe connected to the outlet of the vortex, and said tail pipe having first and second sections, said first section being divergent and said second section being convergent, and said second section being downstream of said first section.

3. In a carburetor for mixing air from an air intake and fuel supply and having a throttle valve for an engine having an intake manifold and exhaust manifold, the improvement in an idling system comprising, an idle fuel tube in communication with the fuel supply and leading into the intake manifold downstream and spaced from the throttle valve, an air modulation passageway one end of which is in communication with air and the second end of which is positioned adjacent the outlet of the idle fuel for controlling the air pressure at the fuel tube outlet thereby controlling the idle fuel flow rate, said modulation passageway including a variable opening, a vortex chamber having an air inlet and positioned adjacent the outlet of the idle fuel tube for atomizing the fuel and air and having an orifice at the vortex chamber outlet, a tail pipe connected to the orifice outlet of the vortex, and said tail pipe having first and second sections, said first section being divergent and said second section being convergent, and said second section being downstream of said first section.

4. In a carburetor for mixing air from an air intake and fuel supply and having a throttle valve for an engine having an intake manifold and exhaust manifold, the improvement in an idling system comprising, an idle fuel tube in communication with the fuel supply and leading into the intake manifold downstream and spaced from the throttle valve, an air modulation passageway one end of which is in communication with air and the second end of which is positioned adjacent the outlet of the idle fuel for controlling the air pressure at the fuel tube outlet thereby controlling the idle fuel flow rate, said modulation passageway including a variable opening, said modulation passageway includes a modulation slot opening into the passageway and positioned adjacent and coacts with the throttle valve, a vortex chamber having an air inlet and positioned adjacent the outlet of the idle fuel tube for atomizing the fuel and air, and a tail pipe connected to the outlet of the vortex.

5. The apparatus of claim 4 including, a fuel-air mixture passageway leading from the tail pipe to a position adjacent each intake valve of each cylinder of the engine.

6. The apparatus of claim 4 including, an exhaust gas supply passageway leading from the exhaust manifold to a point in communication with the idle fuel prior to the discharge of the fuel to the intake manifold.

7. The apparatus of claim 4 including,
heat exchange means between the exhaust manifold and the idle fuel and air mixture at a point prior to the discharge into the intake manifold.

* * * * *